United States Patent [19]

Saiger

[11] Patent Number: 4,828,320

[45] Date of Patent: May 9, 1989

[54] CHAIR FRAME AND CUSHION ASSEMBLY

[75] Inventor: Herbert C. Saiger, Troy, Ohio

[73] Assignee: Winston Furniture Company of Alabama, Inc., Birmingham, Ala.

[21] Appl. No.: 84,911

[22] Filed: Aug. 13, 1987

[51] Int. Cl.[4] ..... A47C 27/00

[52] U.S. Cl. ..... 297/229; 297/444; 297/445

[58] Field of Search ..... 297/219, 229, 226, 344, 297/444, 445, 446, 447, 452

[56] References Cited

U.S. PATENT DOCUMENTS

| | | | |
|---|---|---|---|
| Des. 90,705 | 6/1933 | Goodman . | |
| Des. 103,690 | 3/1937 | Racen . | |
| Des. 105,878 | 8/1937 | Johnson . | |
| Des. 152,129 | 12/1948 | Sanford . | |
| Des. 260,123 | 8/1981 | Lamb . | |
| Des. 263,262 | 3/1982 | Thygesen et al. . | |
| Des. 277,345 | 1/1985 | Kramer et al. . | |
| Des. 280,473 | 9/1985 | Parker . | |
| Des. 282,700 | 2/1986 | Arthur, Jr. . | |
| Des. 282,703 | 2/1986 | Allen . | |
| Des. 285,753 | 9/1986 | Zola . | |
| Des. 287,437 | 12/1986 | Frinier et al. . | |
| 597,878 | 1/1898 | Crandall | 297/219 X |
| 617,638 | 1/1899 | Carter | 297/229 X |
| 1,404,451 | 1/1922 | Love | 297/229 |
| 1,701,441 | 2/1929 | Coppock . | |
| 1,885,109 | 11/1932 | Burkart . | |
| 1,909,901 | 5/1933 | Sallop | 297/226 |
| 2,326,937 | 8/1943 | Frei . | |
| 2,534,502 | 12/1950 | Dewey . | |
| 2,797,743 | 7/1957 | Rodtz, Jr. | 297/229 |
| 3,078,101 | 2/1963 | Reese | 297/229 X |
| 4,188,065 | 2/1980 | Meeker | 297/219 X |
| 4,482,186 | 11/1984 | Gomes | 297/226 X |
| 4,580,840 | 4/1986 | Cunningham et al. | 297/219 X |
| 4,643,480 | 2/1987 | Morita | 297/452 X |
| 4,676,376 | 6/1987 | Keiswetter | 297/229 X |

FOREIGN PATENT DOCUMENTS

| | | | |
|---|---|---|---|
| 2727438 | 12/1978 | Fed. Rep. of Germany | 297/226 |
| 3201237 | 7/1983 | Fed. Rep. of Germany | 297/229 |
| 1032167 | 6/1953 | France | 297/219 |
| 566272 | 8/1957 | Italy | 297/229 |
| 7714930 | 7/1979 | Sweden | 297/229 |

*Primary Examiner*—Peter A. Aschenbrenner
*Assistant Examiner*—Thomas A. Rendos
*Attorney, Agent, or Firm*—Bell, Seltzer, Park & Gibson

[57] ABSTRACT

A chair and cushion assembly is disclosed. The assembly comprises a first frame component, a second frame component, and a back cushion. The first frame component includes a generally upright back support member of generally inverted U-shape. The second frame component includes a generally upright cushion support member of generally inverted U-shape. The cushion support member is positioned generally parallel to and spaced below the back support member. The back cushion has a pocket formed on the rear surface thereof, with the pocket receiving the cushion support member so that the back cushion is secured in place thereby.

3 Claims, 2 Drawing Sheets

CHAIR FRAME AND CUSHION ASSEMBLY

FIELD OF THE INVENTION

This invention relates to furniture construction, and particularly relates to the construction of chairs, sofas, love seats and the like in which the back cushion is removably mounted thereon.

BACKGROUND OF THE INVENTION

Furniture constructed of wrought iron, aluminum, rattan, plastic, and other such materials has become increasingly popular. With this increased popularity, a need to provide a greater variety of designs has also emerged. Design variety helps to distinguish products from one another, permits this type of furniture to fit within a greater variety of decorating schemes, and ultimately serves to increase the sales of these products.

The furniturue with which the present invention is concerned is characterized by having a visible frame and removable cushions mounted thereon. Such furniture is frequently used as outdoor furniture, but is attractive and functional in indoor settings as well. The removable cushions are particularly advantageous for outdoor furniture, as they can be removed during off seasons and replaced when they become worn or soiled. Indoors, removable cushions permit styling changes to be more easily accomplished.

A problem with removable cushions, particularly back cushions, is that they often given an appearance of being simply sat in place on the frame, rather than giving the appearance of being an integral part of the completed frame and cushion assembly. Another problem is that the cushions are not firmly and securely mounted in place. To provide greater styling options, it would also be desirable to have a chair and cushion assembly which provided an appearance like that of a piece of upholstered frame furniture, where the back cushion is permanently built upon the chair frame, without the supporting structure visible, and a decorative trim is provided along the edges of the back cushion.

Accordingly, an object of this invention is to provide a chair and cushion asembly which provides a removable back cushion which can be firmly and securely mounted on the back portion of the chair frame.

A still further object of the present invention is to provide a chair and cushion assembly for exposed frame furniture which provides a visible trim about the edges of the cushion.

SUMMARY OF THE INVENTION

The foregoing and other objects and advantages are achieved by the chair and cushion assembly disclosed herein. The assembly comprises a first frame component which includes a generally upright back support member of generally inverted U-shaped and a second frame component which includes a generally upright cushion support member of generally inverted U-shape. The second frame component is fixedly connected to the first frame component. The cushion support member is positioned generally parallel to and spaced below the back support member. The assembly further comprises a back cushion having a pocket formed on the rear surface thereof. The back pocket receives the cushion support member so that the back cushion is secured in place by the cushion support member and the back support member is visible adjacent the back cushion.

BRIEF DESCRIPTION OF THE DRAWINGS

The chair and cushion assembly described above will be explained in detail by the following description and drawings, in which.

DETAILED DESCRIPTION OF THE INVENTION

Figure 1:
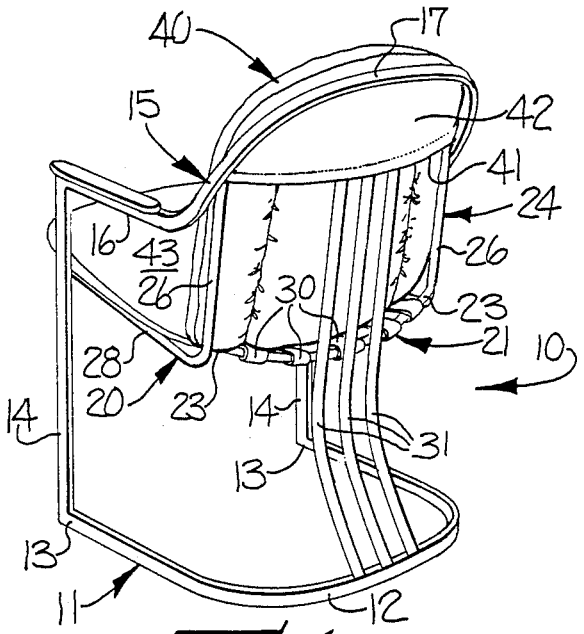
FIG. 1 is a perspective view of the back of a chair and cushion assembly of the present invention.

FIGS. 1 through 4, as noted above, together illustrate a first embodiment of an arm chair 10 and cushion 40 assembly of the present invention. The arm chair 10 has a first frame component 11, with the first frame component comprising a U-shaped horizontal base 12 having opposite ends 13, a pair of uprights 14 joined to the opposite ends of the base, and an upper support member 15. The upper support member has opposite, generally parallel side arm portions 16 which are positioned substantially horizontally and are joined to respective ones of said uprights 14. The first frame component also includes a medial, arcuately curved and generally upright back support member 17. The first frame component is preferably constructed of tubular steel which is rectangular in cross-section.

The arm chair has a second frame component 20 which is connected to the first frame component. The second frame component is preferably constructed of tubular steel which is round in cross-section. The second frame component has a generally rectangular seat portion 21 which has a pair of front corners 22 and a pair of rear corners 23, with each of the front corners 22 joined to respective ones of the pair of uprights 14, such as by welding. The seat portion 21 also includes a plurality of parallel plastic straps 30 of conventional design.

Figure 2:
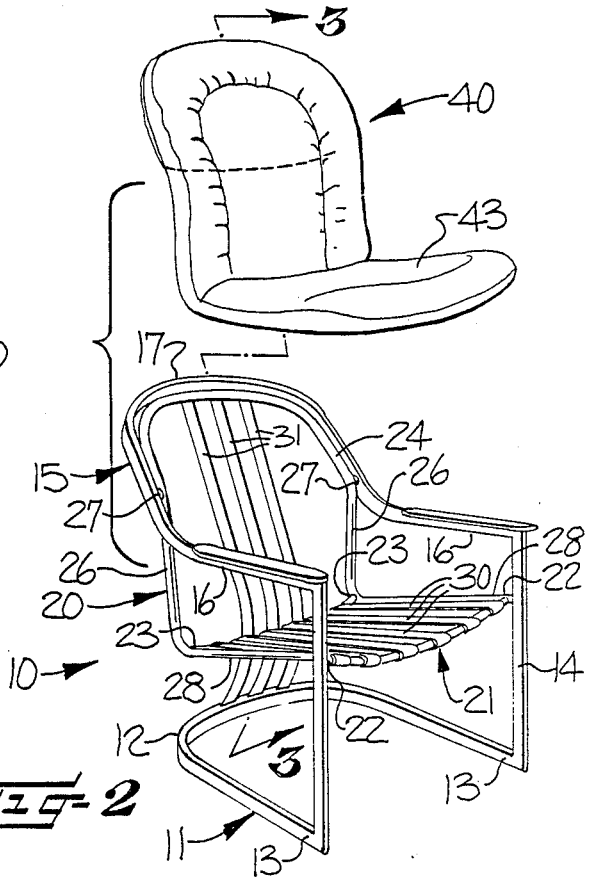
FIG. 2 is an exploded view of the chair and cushion assembly shown in FIG. 1, as seen from the front side thereof.

The second frame component also includes a rear member 24 of generally inverted U-shape, which rear member defines opposite ends 26 and a medial, arcuately curved and generally upright cushion support member 25. The opposite ends 26 of the rear member are joined to respective ones of the rear corners 23 of the seat portion 21. The cushion support member 25 is disposed generally parallel to and spaced below the back support member 17 of the first frame component 11. As best shown in FIG. 2, the lateral side portions 28 of the seat portion 21 are formed from an integral extension of the opposite ends 26 of the same tubular member which forms the cushion support member 25, with the ends connected to opposite uprights 14. Thus the cushion support member 25 and the lateral side portions 28 of the seat portion 21 are constructed of a single elongate tubular member, which enhances the strength and simplifies the construction of the chair 10.

Figure 3:
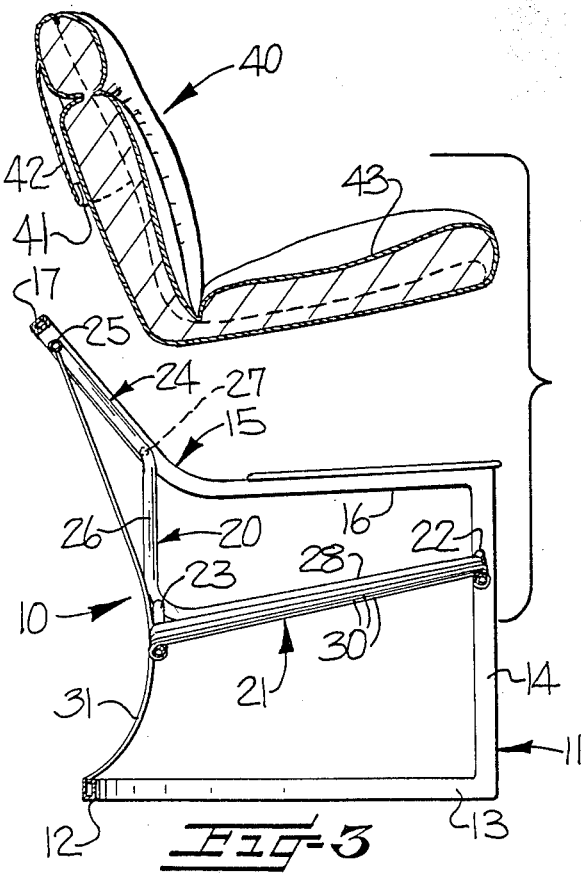
FIG. 3 is an exloded view in section of the chair and cushion assembly taken along line 3—3 in FIG. 2.
Figure 4:
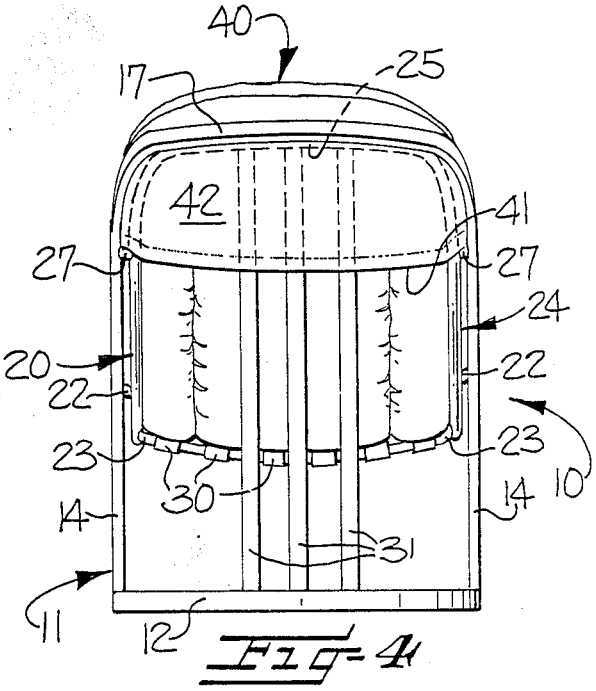
FIG. 4 is a back view of the chair and cushion assembly shown in FIG. 1.

The assembly, as noted above, includes a back cushion 40. The back cushion has a pocket 41 formed on the rear surface thereof by means of an overlying flap 42 sewn to the back cushion along the top and two sides thereof, as best shown in FIG. 3. A seat cushion 43 is joined to the bottom edge portion of the back cushion 40, though the seat cushion 43 and the back cushion 40 could optionally be separate. As shown in FIGS. 1 and 4, the back pocket 41 receives the cushion support member 25 of the rear member 24 so that the back cushion is secured in place, and the back support member 17 of the first frame component 11 is visible above the back cushion.

FIGS. 2 and 4 show that the back support member of the first frame component 11 and the rear member of the second frame component 20 are interconnected at a pair of locations positioned, respectively, adjacent the junctures of the first arm portions 16 and the back support member 17 of the first frame component. This interconnection is accomplished through a pair of spacers 27 which serve to maintain the cushion support member 25 generally parallel to and spaced below the back support member 17. In addition, the chair further comprises back support means in the form of three metal posts 31 extending substantially vertically between the cushion support member 25 and the base 12, with the back support means being secured to the back side edge portion 29 of the seat between the rear corners thereof. The back side edge portion 29, as shown in FIGS. 3 and 4, is formed from an elongate rod connected between the rear end portions of the lateral side portions 28 of the seat portion 21.

Figure 5:
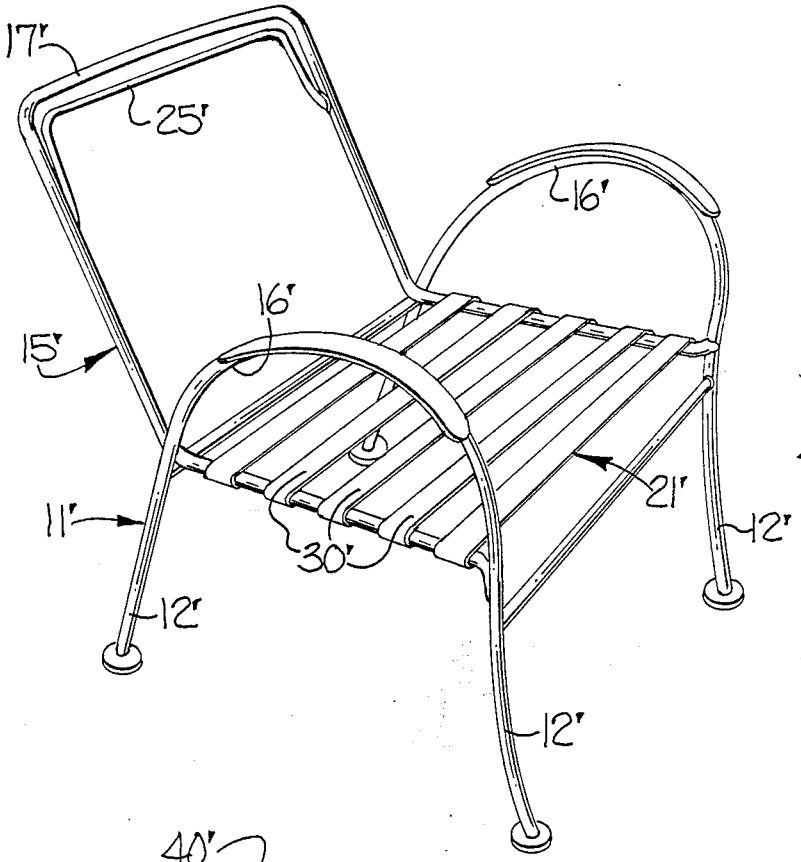
FIG. 5 is a perspective view of a second embodiment of the present invention showing the front thereof.
Figure 7:
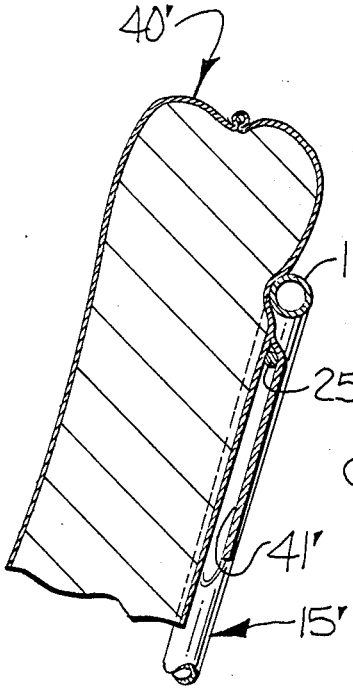
FIG. 7 is a cross-sectional view of the chair and cushion assembly shown in FIG. 6 taken along line 7—7 thereof, showing the details of how the cushion is mounted on the chair.
Figure 6:
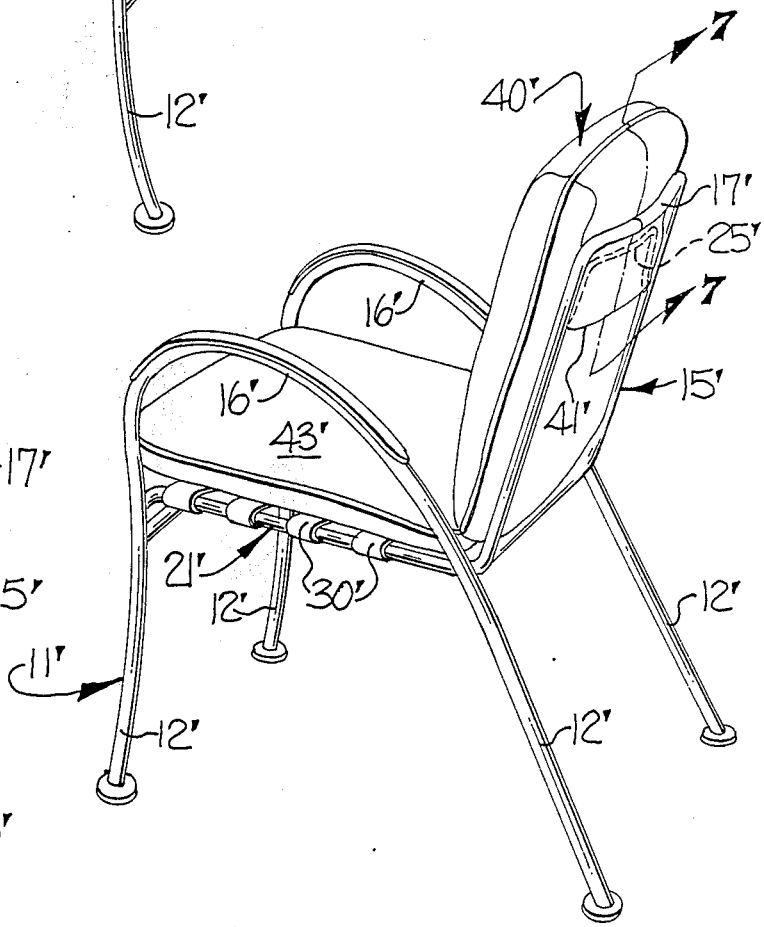
FIG. 6 is a perspective view of the chair shown in FIG. 5 with the cushion mounted thereon and showing the back thereof.

A second embodiment of the invention is shown in FIGS. 5 through 7. The arm chair illustrated in these figures has a first frame component 11' comprising a base 12' in the form of four upright legs, and an upper support member 15' joined to the base. The upper support member has opposite, generally parallel side arm portions 16' which extend substantially horizontally, and with each side arm portion 16' being composed of an integral extension of the two upright legs on the associated side of the chair. Also, the upper support member 15' includes a medial, generally upright back support member 17' of generally inverted U-shape. A generally rectangular and horizontal seat portion 21' is joined to the base, and a plurality of plastic straps 30' extend across the seat portion.

The arm chair has, in addition, a second frame component in the form of a rear member of generally inverted U-shape which defines a cushion support member 25'. The opposite ends of the U-shaped cushion support member 25' are joined to the respective sides of the back support member 17', and such that the cushion support member 25' is disposed generally parallel to, and spaced below, the back support member 17'.

FIGS. 6 and 7 illustrate that the assembly includes a back cushion 40' having a pocket 41' formed on the rear surface thereof. The pocket receives the cushion support member 25' of the rear member so that the back cushion is secured in place and the back support member 17' is visible at the rear side of the back cushion. The back cushion 40' is connected to the seat cushion 43' to prevent the back cushion from being forced through the opening in the upright back support member. Alternatively, rigidifying means could be incorporated within the cushion, or the opening could be closed with straps, in like manner to the seat support.

The present invention has been discussed with a degree of specificity above. This discussion is provided for illustrative purposes only, with the scope of the invention being defined by the following claims.

That which is claimed is:

1. An arm chair comprising a first frame component comprising a U-shaped horizontal base having opposite ends, a pair of uprights joined to said opposite ends of said base, and an upper support member, said upper support member having opposite, generally parallel side arm portions which extend substantially horizontally and are joined to respective ones of said uprghts, and a medial, arcuately curved and generally upright back support member, and a second frame component connected to said first frame component and comprising a generally rectangular seat portion having a pair of front corners and a pair of rear corners, with said front corners being joined to said pair of uprights, and a rigid rear member of generally inverted U-shape so as to define opposite ends and a medial, arcuately curved and generally upright cushion support member, with said opposite ends of said rear member being joined to respective ones of said rear corners of said seat, and with said cushion support member being disposed generally parallel to and spaced below said back support member of said first frame component, and said back support member of said first frame component and said rear member of said second frame component being fixedly interconnected at a pair of locations positioned respectively adjacent the junctures of said side arm portions and said back support member of said first frame component.

2. The arm chair as defined in claim 1 further comprising back support means extending substantially vertically between said cushion support member and said base, with said back support means being secured to said seat between said rear corners thereof.

3. The arm chair as defined in claim 1 further comprising a back cushion having a pocket formed on the rear surface thereof, with said pocket receiving said cushion support member of said rear member so that said back cushion is secured in place and said back support member of said first frame component is visible adjacent said back cushion.

* * * * *